US007818934B2

(12) United States Patent
Hall et al.

(10) Patent No.: US 7,818,934 B2
(45) Date of Patent: Oct. 26, 2010

(54) CURTAIN WALL MULLION SEALING BRIDGE

(75) Inventors: Greg A. Hall, Forney, TX (US); Fred A. Grunewald, Rockwall, TX (US); James P. Clark, Terrell, TX (US)

(73) Assignee: Oldcastle Glass Engineered Products, Inc., Plano, TX (US)

( * ) Notice: Subject to any disclaimer, the term of this patent is extended or adjusted under 35 U.S.C. 154(b) by 1190 days.

(21) Appl. No.: 11/253,020

(22) Filed: Oct. 18, 2005

(65) Prior Publication Data

US 2006/0080917 A1 Apr. 20, 2006

Related U.S. Application Data

(60) Provisional application No. 60/619,661, filed on Oct. 18, 2004.

(51) Int. Cl.

| | |
|---|---|
| ***E04B 1/70*** | (2006.01) |
| ***E04H 1/00*** | (2006.01) |
| ***E04F 17/00*** | (2006.01) |
| ***E04C 3/00*** | (2006.01) |

(52) U.S. Cl. ..... 52/302.6; 52/235; 52/302.1; 52/459

(58) Field of Classification Search ..... 52/235, 52/302.1, 302.6, 459, 204.1, 506.01, 465, 52/470, 461, 204.61, 664, 665
See application file for complete search history.

(56) References Cited

U.S. PATENT DOCUMENTS

| | | | | |
|---|---|---|---|---|
| 334,160 | A | | 1/1886 | Berger |
| 2,282,631 | A | | 5/1942 | Winship |
| 2,703,002 | A | | 3/1955 | Suskind |
| 2,777,405 | A | | 1/1957 | Ager |
| 2,810,173 | A | | 10/1957 | Bearden |
| 2,963,126 | A | * | 12/1960 | Cudini ..... 52/302.6 |
| 3,147,518 | A | | 9/1964 | Horgan |
| D199,828 | S | | 12/1964 | Regan |
| 3,359,700 | A | * | 12/1967 | Birum, Jr. ..... 52/468 |
| 3,522,684 | A | | 8/1970 | Grossman |
| D223,640 | S | | 5/1972 | Kemp |
| D229,757 | S | | 1/1974 | Hansen |
| 3,787,130 | A | * | 1/1974 | Hemmings et al. ..... 403/205 |
| 3,798,862 | A | * | 3/1974 | Stoakes ..... 52/204.591 |
| D241,312 | S | | 9/1976 | McLintock et al. |
| 4,006,573 | A | | 2/1977 | Biebuyck |
| 4,050,201 | A | | 9/1977 | Hubbard et al. |
| 4,055,923 | A | | 11/1977 | Biebuyck |

(Continued)

FOREIGN PATENT DOCUMENTS

| | | |
|---|---|---|
| JP | 03-013644 | 1/1991 |

(Continued)

*Primary Examiner*—Richard E Chilcot, Jr.
*Assistant Examiner*—Andrew J Triggs
(74) *Attorney, Agent, or Firm*—Winstead PC

(57) ABSTRACT

A mullion sealing bridge and method for use in a curtain wall system. In one aspect, the bridge is placed at an intersection horizontal and vertical mullions to divert fluid along the curtain wall system. This Abstract is provided to comply with rules requiring an Abstract that allows a searcher or other reader to quickly ascertain subject matter of the technical disclosure. This Abstract is submitted with the understanding that it will not be used to interpret or limit the scope or meaning of the claims.

8 Claims, 4 Drawing Sheets

U.S. PATENT DOCUMENTS 4,075,800 A 2/1978 Molick
4,101,233 A 7/1978 McConnell
D250,189 S 11/1978 Hansen
4,214,405 A 7/1980 Chupik
4,276,729 A 7/1981 Kage et al.
4,307,551 A 12/1981 Crandell
4,307,976 A 12/1981 Butler
4,310,995 A 1/1982 Hanna
4,364,209 A 12/1982 Gebhard
4,370,827 A 2/1983 Furuminato
4,387,542 A 6/1983 Wehr
4,488,378 A 12/1984 Symon
4,519,173 A 5/1985 Roberts
4,545,161 A 10/1985 Baumann
4,573,287 A 3/1986 Hagemeyer
4,611,447 A 9/1986 Krechel
4,614,069 A 9/1986 Tanikawa
4,619,092 A 10/1986 Kaminaga
4,627,201 A 12/1986 Hamamoto
4,633,631 A 1/1987 Crandell
4,638,613 A * 1/1987 Tonsmann ..... 52/235
4,644,717 A 2/1987 Biebuyck
4,662,136 A 5/1987 Tanikawa
4,662,145 A 5/1987 Tanikawa
4,680,902 A 7/1987 Stefnik
4,685,263 A 8/1987 Ting
D293,885 S 1/1988 Carlmark
4,720,876 A 1/1988 Tomei
4,724,637 A 2/1988 Evans
4,773,193 A 9/1988 Biebuyck
4,783,941 A 11/1988 Loper
4,799,344 A 1/1989 Francis
4,803,820 A 2/1989 Metrick
4,817,351 A 4/1989 Michlovic
4,841,700 A 6/1989 Matthews
4,854,095 A * 8/1989 Michlovic ..... 52/235
4,866,896 A 9/1989 Shreiner
4,873,806 A 10/1989 Jeschke
4,899,508 A 2/1990 Biebuyck
4,910,931 A 3/1990 Pardue, Jr.
D310,847 S 9/1990 Dietz
4,956,948 A 9/1990 Hart
4,956,954 A 9/1990 Horgan
4,984,400 A 1/1991 Bockmiller
4,996,809 A 3/1991 Beard
5,036,637 A 8/1991 Biebuyck
5,058,344 A 10/1991 Biebuyck
5,065,557 A 11/1991 Laplante
5,077,947 A 1/1992 Takeda
5,185,979 A 2/1993 Azzimonti
5,252,154 A 10/1993 Hoffman
5,253,459 A 10/1993 Parinas
D347,857 S 6/1994 Coe
5,319,882 A 6/1994 Biebuyck
5,333,428 A 8/1994 Taylor
5,354,410 A 10/1994 Cohen
5,369,924 A * 12/1994 Neudorf ..... 52/235
D363,453 S 10/1995 Herdt
5,469,665 A 11/1995 Biebuyck
5,481,839 A * 1/1996 Lang et al. ..... 52/235
5,546,713 A 8/1996 Voegele
5,560,149 A 10/1996 Lafevre
5,590,492 A 1/1997 Cucchiara et al.
5,592,795 A 1/1997 Rinehart
5,596,851 A 1/1997 Ting
D378,219 S 2/1997 Marshlack
5,644,875 A 7/1997 Nielsen et al.
D393,813 S 4/1998 Herdt
5,746,032 A 5/1998 Koike
5,749,175 A 5/1998 Koike
5,771,652 A 6/1998 Nagata et al.
5,839,236 A * 11/1998 Frey ..... 52/235
5,875,602 A 3/1999 Lappin et al.
5,893,244 A 4/1999 Magoon
5,930,955 A 8/1999 Biebuyck
5,937,597 A 8/1999 Sono
5,950,370 A 9/1999 Peck
6,158,182 A 12/2000 Biebuyck
6,226,940 B1 5/2001 Biebuyck
6,581,342 B1 6/2003 Tavivian
6,715,248 B2 4/2004 Biebuyck
6,745,527 B1 * 6/2004 Sherman et al. ..... 52/235
6,804,920 B2 * 10/2004 Hogan ..... 52/235
6,993,873 B2 2/2006 Biebuyck et al.
7,191,566 B2 3/2007 Back et al.
7,389,617 B2 * 6/2008 Grunewald ..... 52/235
2002/0152693 A1 10/2002 Krogstad
2004/0163329 A1 8/2004 Back et al.
2005/0000181 A1 * 1/2005 Grunewald ..... 52/459
2005/0138875 A1 * 6/2005 Grunewald et al. ..... 52/302.1
2005/0138889 A1 6/2005 Biebuyck
2006/0080917 A1 * 4/2006 Hall et al. ..... 52/235
2006/0201084 A1 * 9/2006 Arias ..... 52/235

FOREIGN PATENT DOCUMENTS

JP 06-065977 3/1994
JP 06-158762 6/1994
JP 06-322866 11/1994

* cited by examiner

CURTAIN WALL MULLION SEALING BRIDGE

CROSS-REFERENCE TO RELATED APPLICATIONS

This application claims priority from and incorporate by reference the entirety of U.S. Provisional Application Ser. No. 60/619,661, entitled "Curtain Wall Mullion Sealing Bridge," filed Oct. 18, 2004.

BACKGROUND OF THE INVENTION

1. Field of the Invention

The present invention relates to building curtain walls and, more particularly, but not by way of limitation, to methods of and apparatus for horizontal mullion bridging and sealing for collecting and diverting fluids, such as water infiltrating into the curtain wall system outwardly therefrom.

2. Description of Related Art

The above summary statement as to the field of the present invention is not intended to represent each embodiment or every aspect of the present invention. The advantages of building curtain wall technology are well known and accepted in the industry. Curtain walls are typically constructed of extruded aluminum frame support having generally U-shaped channels (although other shapes may apply) for supporting a plurality of panel members that serve as the exterior of a building. Such panel members are most often panes of glass, and often double pane glass sections, but other paneled building materials such as aluminum, granite, slate, or concrete are also utilized. Such panel members are often of identical size and shape. However, near doors, opening windows, or other access points into the building, panel members of different sizes and shapes may be utilized.

Curtain walls generally include a plurality of extruded horizontal members intersecting with vertical members. These vertical and horizontal extruded members will be referred to herein as mullions. The horizontal mullions are typically formed with structural body regions and tongue portions extending outwardly therefrom to facilitate the mounting of the panels. For this reason, an open intersection space is generally formed between the tongue portions of the horizontal mullions at the point where the vertical mullions intersect them. It typically is necessary to fill this tongue intersection space with a combination of material and sealant in order to control the collection and flow of moisture emanating from condensation, precipitation, etc. Typical remedies for removing the fluids that collect along horizontal mullions involve apparatus and systems for bridging and channeling the flow of fluid to exit portions of the curtain wall system. Such systems and apparatus often typically require intense manual labor at the job site to adequately provide the necessary seals, subassemblies and alignment of sealant and/or parts therefor relative to assembly of the curtain wall sections. One such relative part or subassembly involves a member referred to as a thermal isolator. The thermal isolator is an elongate, elastomeric member that is typically mounted along the frontal surface of a horizontal mullion. This horizontal surface typically includes a flanged region of the mullion that provides spacing for glass panels, or the like, as well as a means for mounting the thermal isolator therealong. This aspect will be discussed in more detail below.

Referring specifically now to the mullion intersection space, one example of a construction approach sometimes used in the industry and referenced above, is the manual application of sealant around vertical mullions at the intersection of horizontal mullions. The sealant must be manually ramped at an incline to force the collecting fluid out of the intersection and toward the exit portion along the horizontal mullion. With this technique, the quality of the ramping of the sealant is obviously dependent on the skill and care of the laborer. The operation also adds additional cost and time to the project. Furthermore, human error and inconsistency is introduced when vast quantities of labor are required to apply sealant in the curtain wall system. Two patent applications that address these and related water diversion issues are U.S. patent application Ser. No. 10/836,081, filed Apr. 29, 2004, and U.S. patent application Ser. No. 10/833,990, filed Apr. 27, 2004, both assigned to the assignee of the present invention and incorporated herein by reference.

Yet another approach to the problem described above is the use of a preformed barrier plug adapted for positioning at the intersection of the horizontal and vertical mullions. A typical barrier plug may fill the space normally occupied by both the horizontal mullion tongue and the thermal isolator secured therealong. In such configurations, the thermal isolator is generally cut where it engages the barrier plug. The thickness of the barrier plug is that necessary to accommodate the spacing of the flange and the thermal isolator for flush receipt of a pressure plate outwardly thereof. The uniformity and consistency of the mounting of a pressure plate against a thermal isolator is important, and problems can occur when the thermal isolator must be cut and applied in sections. The present invention addresses these problems by providing a method and apparatus permitting a continuous length of thermal isolator material to be secured along the horizontal mullion of a curtain wall and uniformly across the junction of a vertical mullion in association therewith.

BRIEF SUMMARY OF THE INVENTION

The present invention relates to a method of and apparatus for horizontal mullion bridging, sealing and moisture diversion in a curtain wall system. The method and apparatus of the invention comprise, in one embodiment, a preformed, selectively designed moisture diversion bridge constructed with a size and frontal profile that is substantially similar to the size and frontal profile of the adjacent horizontal mullion tongues and adapted for securement at the intersection of the horizontal and vertical mullions. In one aspect, the above-described moisture diversion bridge is placed at the intersection of the vertical and horizontal mullions where the end of a first horizontal mullion tongue and spaced therefrom across the face of the vertical mullion. The moisture diversion bridge is formed to retain and divert fluid such as moisture along the horizontal mullion for subsequent discharge out of the curtain wall system through weep holes by being mounted in and sealed along the intersection of the vertical and horizontal mullions.

In one embodiment of the invention, the weep holes may be formed in a variety of positions along both a pressure plate and a cover plate mounted thereover. The moisture diversion bridge of the present invention may also include a size and front profile which is sufficiently similar to the size and profile of the oppositely disposed horizontal mullion tongues to which the bridge is mounted so that a conventional thermal isolator may extend uninterrupted thereacross. In this manner, a continuous strip of thermal isolator material may be maintained thereover, without cutting around a conventional barrier plug. In this particular embodiment, the horizontal mullion is thus provided with a bridging element that substantially resembles the adjacent regions of the horizontal mullion tongue to the extent that it is adapted for receiving sealing members thereagainst in an uninterrupted fashion.

Such method and apparatus thus improve multiple characteristics of the curtain wall system in accordance with the principles of the present invention.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE PREFERRED EMBODIMENT

It has been discovered that filling and sealing voids between vertical and horizontal mullions of a curtain wall system can be both time consuming and expensive. It has also been discovered that an uninterrupted mounting of a thermal isolator across horizontal mullions and aligned members secured therewith is advantageous. An uninterrupted mounting means that single strips of material may be installed across horizontal mullions even over intersections with vertical mullions. This permits fewer human errors and more efficiency in assembly. Since reliable sealing of the intersection between the vertical and horizontal mullions is necessary for most applications in order to prevent uncontrolled water passage, the voids created by the intersection of non-planar members, such as the vertical and horizontal mullions of a curtain wall system, present a number of design issues. The previous utilization of rigid sealing members such as conventional barrier plugs with sizes and frontal profiles not adapted to accommodate the continuous mounting of a thermal isolator thereacross has thus prompted attention to this assembly aspect. The moisture diversion bridge and system of the present invention provides a more reliable, less expensive and less time consuming method and apparatus for diverting moisture out of the curtain wall while facilitating receipt of a continuous thermal isolator across the horizontal mullion region.

Figure 1:
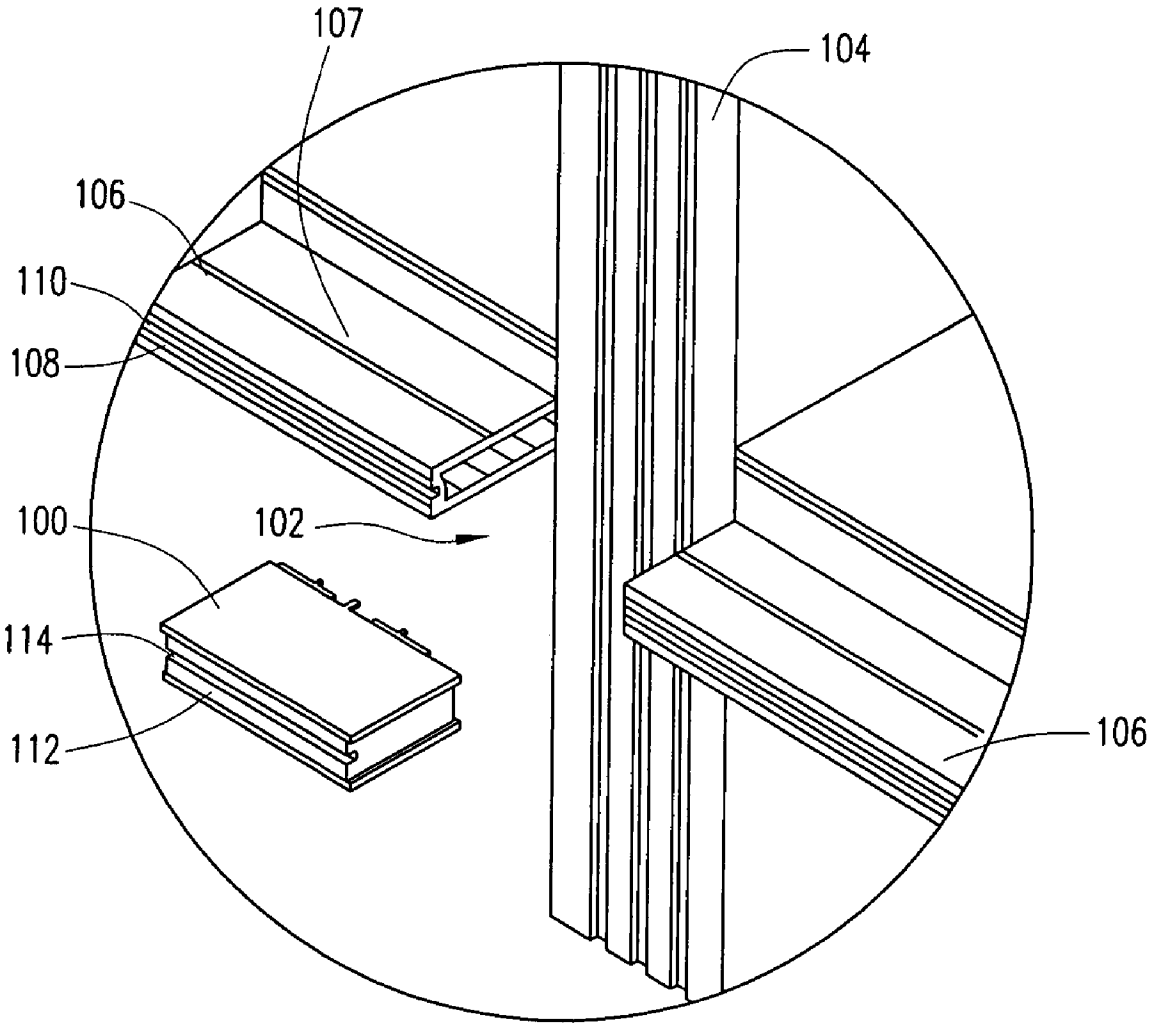
FIG. 1 is an exploded, perspective view of one embodiment of the mullion sealing bridge of present invention in position for mounting in a curtain wall.

Referring now to FIGS. 1-5, there is shown one embodiment of a moisture diversion bridge 100 constructed in accordance with the principles of the present invention and the mounting thereof. FIG. 1 illustrates a top perspective view of one embodiment of a moisture diversion bridge 100 constructed in accordance with the present invention. The bridge 100 is disposed in a space or void 102 defined by the intersection of vertical mullion 104 and horizontal mullion 106. It may be seen that the frontal profile 108 of horizontal mullion 106 includes a flange section 107 formed with a recess 110 therein adapted for receipt of a thermal isolator member thereacross as will be defined in more detail below. Likewise, in accordance with the principles of the present invention, the moisture diversion bridge 100 is constructed of a size substantially similar to flange section 107 and a frontal profile 112 which is substantially similar to the frontal profile 108. The bridge 100 also includes a slotted region 114 of similar size and shape to slotted region 110 of horizontal mullion 106. As will be illustrated and described below, placement of the bridge 100 within the space or void 102 in alignment with mullion 106 will allow a substantially mating engagement between the bridge 100 and the contour of the vertical mullion 104 therein facilitating alignment of the frontal profile 112 relative to frontal profile 108. Such alignment is consistent with the principles of one embodiment of the present invention that allows the uninterrupted extension of a thermal isolator thereacross.

Figure 2:
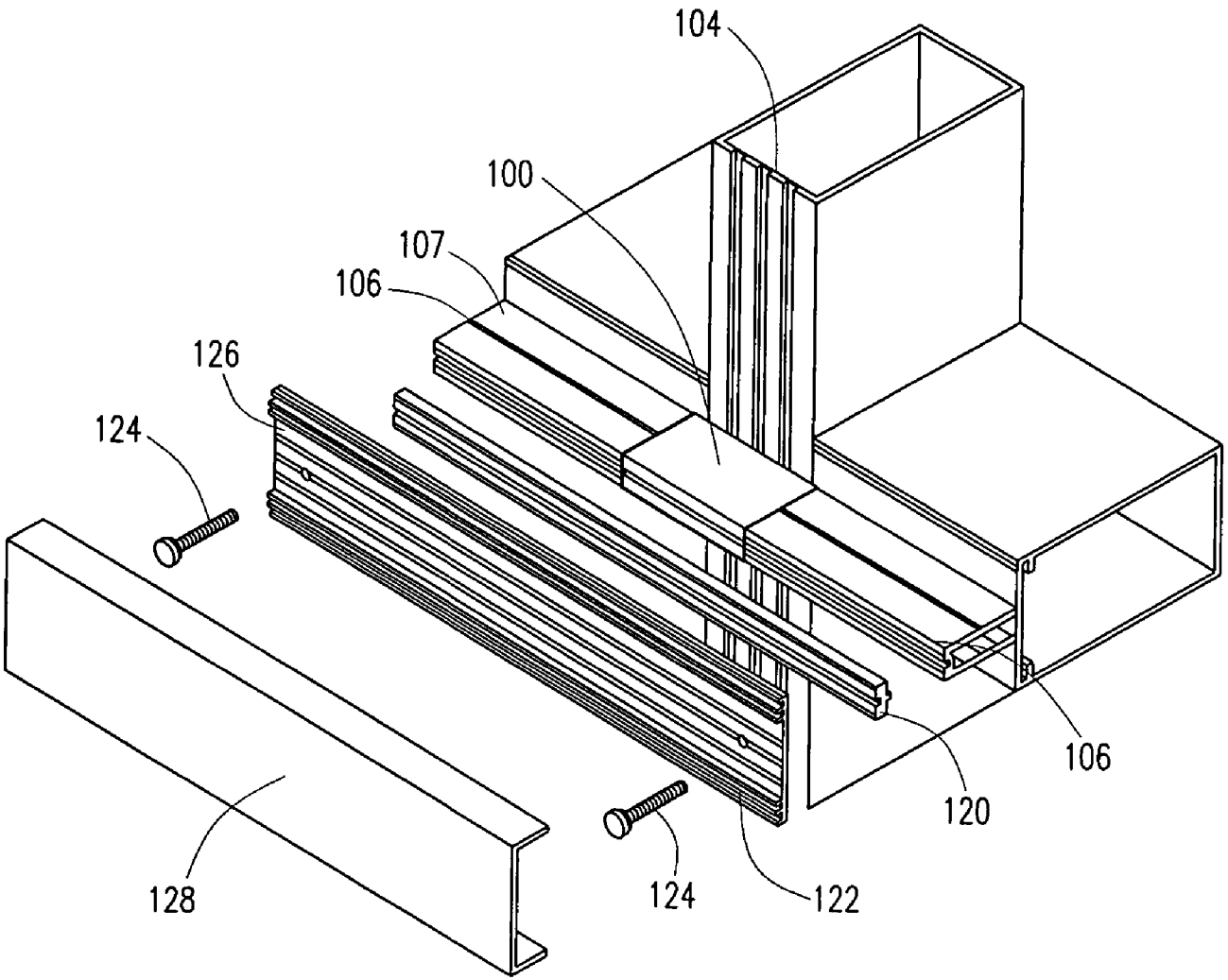
FIG. 2 is a perspective view of the bridge of FIG. 1 in a mounted configuration within the curtain wall and illustrating in an exploded view the assembly of other elements of a curtain wall system.

Referring now to FIG. 2, there is shown an enlarged perspective view of the bridge 100 mounted in the void 102 and assembled contiguous both the vertical and horizontal mullions 104 and 106, respectively. In this position conventional sealant, such as silicone, can be applied around the perimeter of the bridge 100 and against both the vertical and horizontal mullions 104 and 106 to create a sealed moisture diversion bridge thereacross. Because of the substantial similarity of frontal profiles described above, a thermal isolator 120 may be positioned for uninterrupted mounting thereacross in a manner facilitating ease and accuracy in manual application at a construction job site. It may be seen that the thermal isolator 120 will not require cutting relative to the bridge 100, since the bridge 100 is adapted for receipt of the thermal isolator thereacross in the same manner that the adjacent horizontal mullion sections 106 are adapted for receiving the thermal isolator.

Still referring to FIG. 2, the assembly of the thermal isolator 120 across the horizontal mullions 106 and the bridge 100 disposed therebetween is further facilitated by the application of a pressure plate 122 which is mounted to the horizontal mullion by threaded members 124 that are aligned for passing through apertures 126 formed in the pressure plate 122. The mounting of the pressure plate 122 to a horizontal mullion is well understood as is the application of a frontal cover plate 128 thereover. In the present view, cover plate 128 is positioned for receipt over and around the pressure plate 122 for the aesthetic covering thereof as well as the passage of water therefrom as will be described in more detail below.

Figure 3:
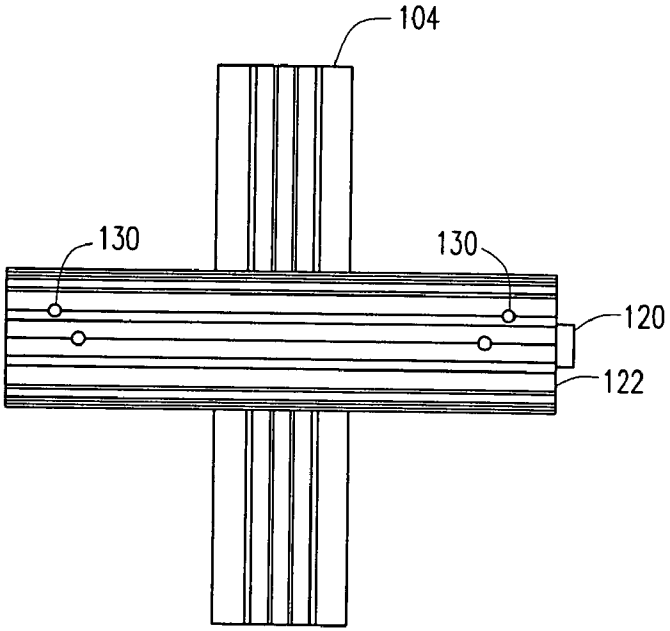
FIG. 3 is a front elevational view of a partial assembly of FIG. 2.

Referring now to FIG. 3, there is shown a front elevational view of the pressure plate 122 placed against the thermal isolator 120. Weep holes 130 are shown formed in the pressure plate 122 and disposed immediately behind and above the thermal isolator 120 disposed therebehind. A section of the thermal isolator 120 is illustrated extending outwardly from the side of pressure plate 122 for purposes of illustration. It may be seen that any water accumulating on the horizontal mullion flange 107 will be allowed to pass therefrom and/or the region of the bridge 100 through the weep holes 130.

Figure 4:
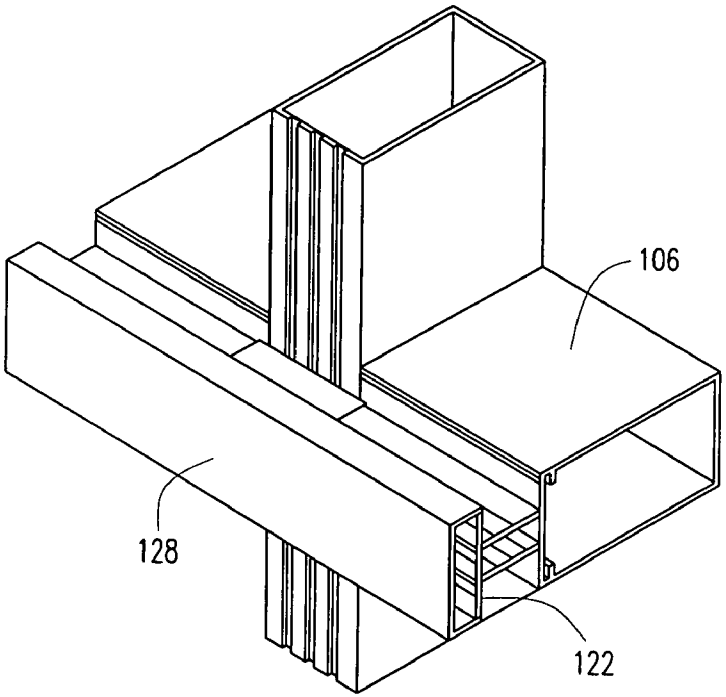
FIG. 4 is a perspective view of the completed assembly of FIG. 2.

Referring now FIG. 4, there is shown a perspective view of the assembled configuration of the cover plate 128 against the pressure plate 122 outwardly of the horizontal mullion 106. In this assembly, it may be seen that the various elements of the assembly are hidden from view to provide a more aesthetically pleasing configuration as is common in conventional curtain wall construction.

Figure 5:
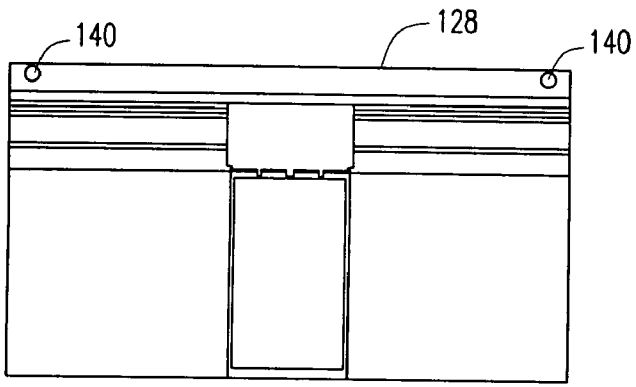
FIG. 5 is a bottom plan view of the assembly of FIG. 4.

Referring now to FIG. 5, there is shown a bottom plan view of the assembly of FIG. 4. In this particular view, cover plate 128 is shown to be formed with weep holes 140 formed in the bottom region thereof. Weep holes 140 allow the passage of moisture downwardly therethrough, which moisture is collected from discharge through the weep holes 130 in pressure plate 122. In this manner, the method of an apparatus of curtain wall mullion sealing of the present invention facilitates the discharge of water from the curtain wall in an aesthetically pleasing configuration.

Figure 6:
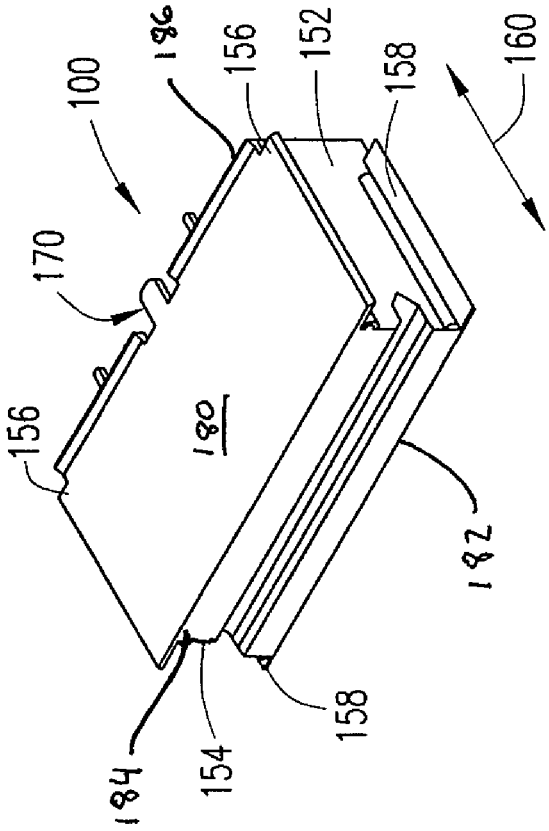
FIG. 6 is an enlarged, perspective view of the mullion sealing bridge of FIG. 1.

Referring now to FIG. 6 there is shown an enlarged perspective view of the embodiment of bridge 100 of FIG. 1 wherein the specific construction thereof may be more readily ascertained. The bridge 100 includes a top surface 180, a bottom surface 182, a front surface 184, and a back surface 186. The opposite sides 152 and 154 of the bridge 100 are constructed with upper and lower flanges 156 and 158, which flanges are adapted to be positioned over and under the ends of the horizontal mullion flanges 107 described above. In one embodiment of the present invention, the bridge 100 can be secured in place utilizing the friction from pressure resulting from the flanges 156 and 158 engagement of the horizontal mullions once the bridge 100 has been slid fully into place. Other securing mechanisms could be utilized such as a snapping mechanism or a threaded fastener. Moreover, the depth of the bridge 100 as shown by arrow 160 is substantially the same as the depth of the horizontal mullion flange 107 described above. In this manner the frontal profile 112 of the bridge 100 does not extend beyond the frontal profile 108 of the flange 107 of horizontal mullion 106. This alignment allows a generally uniform surface for the uninterrupted receipt of the thermal isolator 120 thereacross. It may further be seen that the rear surface 170 of the bridge 100 is constructed with a shape that is particularly adapted for a mating engagement with the vertical mullion 104 shown in FIGS. 1-5. In this manner, sealant may be easily applied around the perimeter of the bridge 100 to provide complete sealing and bridging relative to both the horizontal and vertical mullions 106 and 104, respectively.

Figure 7:
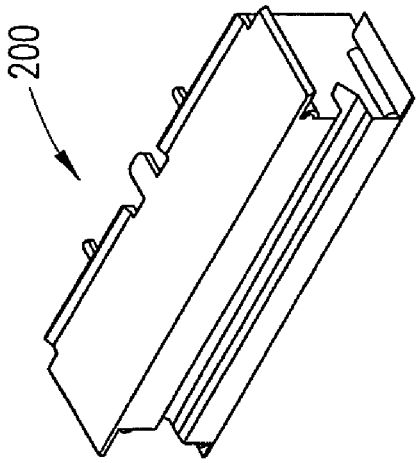
FIG. 7 is a perspective view of an alternative embodiment of the mullion sealing bridge of FIG. 1.

Referring now to FIG. 7 there is shown a second embodiment of the bridge 100 of FIG. 1, in accordance with the present invention. Bridge 200 of FIG. 7 comprises a bridging element of substantially the same overall shape as the bridging element 100 but with less depth. The lesser depth accommodates a horizontal mullion flange (not shown) having less depth as may be necessary in certain curtain wall configurations. Likewise, a variety of sizes as well as shapes of the frontal profile of the bridges 100 and 200 may be necessary in accordance with the principles of the present invention to accommodate various profiles of horizontal mullion flanges as well as thermal isolator mounting designs.

It is thus believed that the operation and construction of the present invention will be apparent from the foregoing description. While the method and apparatus shown or described have been characterized as being preferred it will be obvious that various changes and modifications may be made therein without departing from the spirit and scope of the invention.

What is claimed:

1. A moisture diversion bridge for spanning a horizontal space formed between tongues of horizontal mullions in a curtain wall system of the type wherein the horizontal mullions are secured to opposite sides of vertical mullions such that ends of the tongues of the horizontal mullions are oppositely disposed one from the other defining a space therebetween across a face of the vertical mullion and having front surfaces with substantially identical frontal profiles, the moisture diversion bridge comprising:

a substantially planar top surface for spanning the horizontal space;

a substantially planar bottom surface for spanning the horizontal space;

a front surface including a substantially identical frontal profile as the frontal profiles of the mullion tongues;

a back surface adapted to mate with the face of the vertical mullion;

at least one upper flange protruding on each side of the substantially planar top surface, the at least one upper flange adapted to be positioned over the ends of the oppositely disposed horizontal mullion tongues for providing securement thereto, the at least one upper flange substantially coplanar with the substantially planar top surface and substantially parallel to the horizontal mullion tongues; and at least one lower flange protruding on each side of the substantially planar bottom surface, the at least one lower flange adapted to be positioned under the ends of the oppositely disposed horizontal mullion tongues for providing securement thereto, the at least one lower flange substantially coplanar with the substantially planar bottom surface and substantially parallel to the horizontal mullion tongues and the at least one upper flange.

2. The moisture diversion bridge of claim 1, wherein the moisture diversion bridge has a depth substantially the same as the depth of the oppositely disposed horizontal mullion tongues.

3. The moisture diversion bridge of claim 1, wherein the front surface is adapted for receiving a thermal isolator thereacross.

4. The moisture diversion bridge of claim 3, wherein front surfaces of the oppositely disposed horizontal mullion tongues and the moisture diversion bridge form a surface capable of receiving the thermal isolator continuously thereacross.

5. The moisture diversion bridge of claim 1, further comprising a securing mechanism for securing the moisture diversion bridge in the space.

6. The moisture diversion bridge of claim 5, wherein the securing mechanism includes a plurality of flanges adapted to frictionally engage opposite ends of the horizontal mullions such that the moisture diversion bridge is held in place.

7. The moisture diversion bridge of claim 1, wherein the moisture diversion bridge is adapted to receive sealant placed along at least one side of the top surface thereof.

8. The moisture diversion bridge of claim 7, wherein the sealant comprises silicone.

* * * * *